United States Patent [19]

Nivin

[11] 4,130,125

[45] Dec. 19, 1978

[54] LIGHT-WEIGHT, EASY-ERECTING BARGE HATCH COVER

[75] Inventor: James E. Nivin, Louisville, Ky.

[73] Assignee: American Commercial Barge Line Company, Jeffersonville, Ind.

[21] Appl. No.: 831,648

[22] Filed: Sep. 8, 1977

[51] Int. Cl.[2] ..... B63B 19/14

[52] U.S. Cl. ..... 135/6; 4/172.14; 114/201 R; 214/15 A; 135/4 R; 135/15 CF

[58] Field of Search ..... 135/6, 4 R, 4 A, DIG. 8, 135/15 CF; 214/15 A; 114/201 R; 52/66, 69; 47/26, 28; 296/100, 111; 4/172.12, 172.14

[56] References Cited

U.S. PATENT DOCUMENTS

| | | | |
|---|---|---|---|
| 74,120 | 2/1868 | Naylon | 114/201 R |
| 524,137 | 8/1894 | Enright | 135/6 |
| 1,640,188 | 8/1927 | Grunbock | 214/15 A |
| 2,163,072 | 6/1939 | Spelman | 135/6 |
| 3,405,814 | 10/1968 | Yanow | 135/6 |
| 3,461,891 | 8/1969 | Blomberg | 135/6 |
| 3,822,420 | 7/1974 | Kindness | 4/172.14 |

*Primary Examiner*—Ernest R. Purser
*Assistant Examiner*—Conrad L. Berman
*Attorney, Agent, or Firm*—Laurence R. Brown

[57] ABSTRACT

A tent structure of light-weight reinforced plastic sheet covers the hatch of a barge for weather protection of contents. The cover is stored in compact form aboard the barge for quick erection by a winch system when use is required. The array is secured over the coaming by fastening the cover to the deck at a series of positions with claw hook and chain assemblies. By erecting stored ridge poles to extend above the coaming, the cover thereover provides a pup-tent form which sheds water as a roof, permits loading above the coaming level, and permits loading or unloading in foul weather from the side. Very light-weight reinforced plastic permits a low cost throw-away type assembly with little manpower necessary for erection and produces maximum cargo capacity pay-load and lower maintenance cost by replacement of heavier steel hatch covers.

7 Claims, 13 Drawing Figures

LIGHT-WEIGHT, EASY-ERECTING BARGE HATCH COVER

This invention relates to barges, and more particularly it relates to covers for barge hatches.

BACKGROUND OF THE INVENTION

If perishable goods such as grain, salt, tin sheet or packages are transported by barge, foul weather covers need cover the normally open hatches which are permissible in hauling sand, coal and other non-perishables. In the past, expensive and heavy steel hatch covers have been fitted on a statistical number of barges in a fleet for providing perishables capability. However, if a covered hatch barge is not on site, one must be "dead headed" to receive the sensitive cargo.

The expense and inconvenience of such prior art hatch covers has prevented their more universal use. The heavy steel covers need handling by cranes, derricks or other special equipment and require up to four men for placing or removing and they are difficult to store on board and end up in the wrong places when stored ashore. They weigh so much that cargo capacity is reduced by their weight, and fuel transportation cost with barges empty or full is increased. They rust and are contaminated by cargo so that they need be cleaned for new sensitive cargo. Thus, they have a high maintenace cost. Sometimes they introduce sparks when hitting steel barge coaming which is dangerous in many atmospheres such as in flour dust from wheat, and could cause explosions. Furthermore, a barge cannot be loaded in the rain or foul weater with an open hatch.

OBJECTS OF THE INVENTION

Accordingly, it is a general objective of this invention to improve the state of the art of covered barge hatches.

A more specific object of the invention is to correct one or more of the foregoing deficiencies of the prior art.

Even more specific objects of the invention include the increase of barge pay-load capacity and the reduction in initial and maintenance costs in covering barge hatches to such an extend that more barges in a fleet can be fitted with hatch covers to transport perishable goods.

Another object of the invention is to provide barge hatch covers permitting loading and unloading of perishables in the rain.

Other features, objectives and advantages of the invention will be found throughout the following description and accompanying drawings.

BRIEF DESCRIPTION OF THE INVENTION

Therefore, in accordance with this invention, there is provided a pair of pivotable ridge poles amidships at fore and aft ends of the hatch that can be selectively pivoted down for storage or upright for erection of a hatch cover. A ridge cable (wire, rope, chain, etc.) extends between the upper ends of the erected ridge poles for supporting pup-tent fashion a thin, reinforced, light-weight, water-proof plastic film that extends in a gable array over the hatch and coaming about the edges thereof to keep out water. A winch affixed to the ridge pole is used to tighten the ridge cable. Two stay cables from the end of each ridge pole to opposite sides port and starboard of the coaming support the ends of the pup-tent array and hold the ridge pole erect, one such stay being provided with a winch that serves to erect the ridge pole and tighten the stays. Rope sealed in the fold of the film along the edges is connectd by claw hooks on chains. The cover film has spaced connectors about the edge and mating connector assemblies affixed to the barge to hold the tent cover taut and in place. The plastic is rolled on bobbins and stored when not in use.

THE DRAWING

Other features, objects and advantages will be made evident throughout the following more detailed description, with reference to the accompanying drawing, wherein.

DETAILED DESCRIPTION OF THE INVENTION

Figure 1:
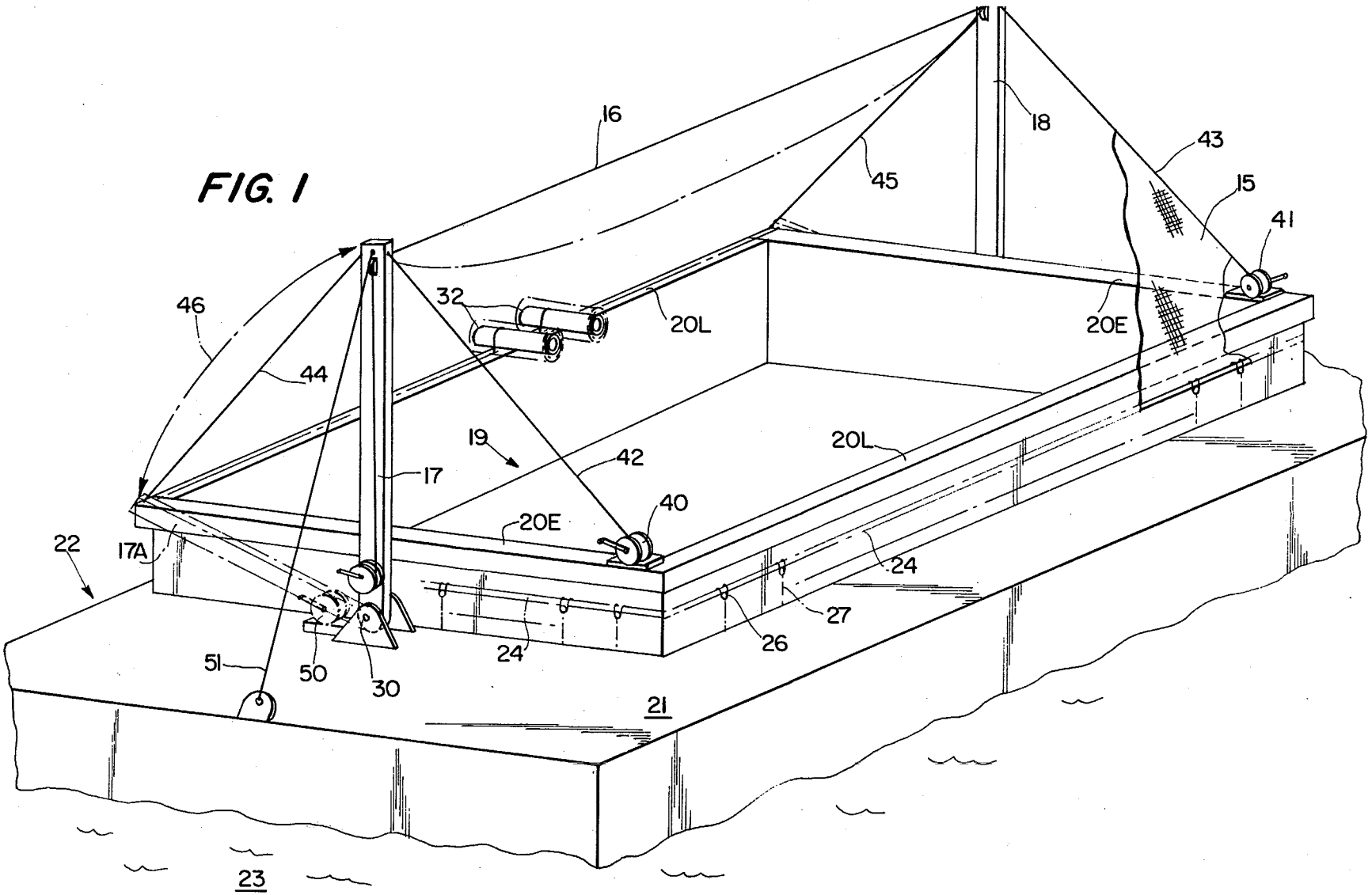
FIG. 1 is a sketch in perspective of the erected pup-tent like hatch cover with phantom lines showing the open hatch storage condition.

THe perspective view of FIG. 1 represents a tent fabric 15 stretched tautly and gabled over a ridge cable 16, and ridge pole 17, 18 assembly pup-tent style to extend above a hatch opening 19 defined by a coaming 20 therearound and positioned amidships on the deck 21 of a barge 22 in water 23. The details and dimensions of the barge 22, not being part of this invention nor necessary for the practice thereof are thus not detailed or shown to scale.

The edges 24 of the tent fabric 15 have connectors 25 for receiving hooks 26 and chain 27 attached to the barge thereby to secure and hold the fabric taut over the edge of the coaming 20. The preferred fabric is a reinforced thin-film poly plastic having two film layers covering a criss cross network of reinforcing fibers. This strong water-proof light-weight fabric is a commercial product obtainable as item No. 250 under the trademark "POLY SCRIM" from Poly Plastic and Design Corp., 1920 E. Pleasant Street, Springfield, Ohio 45501. This fabric can come in four foot strip heat sealed in double section together to form a single fabric of proper length and width.

This whole assembly including ridge poles 17, 18 is stored on deck awaiting erection with the hatch 20 open so that the barge 22 may be used as a conventional open hatch barge for many pay loads including coal, sand, etc. Whenever wheat, or some other perishable, is to be transported, the hatch cover is erected on site. Thus, the barge 22 can always be used at any time for either open or closed hatch service. The assembly is so light that compared with the conventional steel hatch cover, considerable more cargo pay-load can be transported even with open hatch since the steel hatch covers are normally stored on board during an otherwise open hatch trip.

Furthermore, erection cost is comparatively little, requiring less time, no shipyard derricks or cranes and fewer deckhands, and the plastic covers may be even thrown away at lower than maintenance costs of steel hatch covers that rust and need be cleaned from other contamination for various types of payloads. Thus, accumulated oil or bacterial films are not tolerable for wheat cargo, etc.

Figure 3:
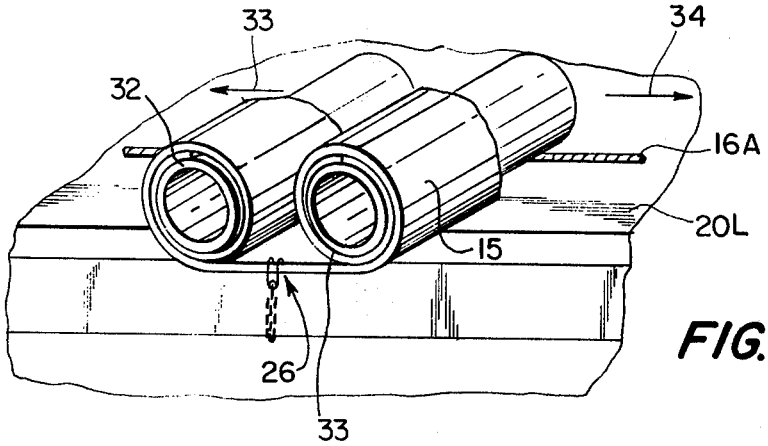
FIGS. 2 and 3 are diagrammatic views of the storage of the tent fabric in readiness for simple erection by folding and rolling on bobbins.
Figure 2:
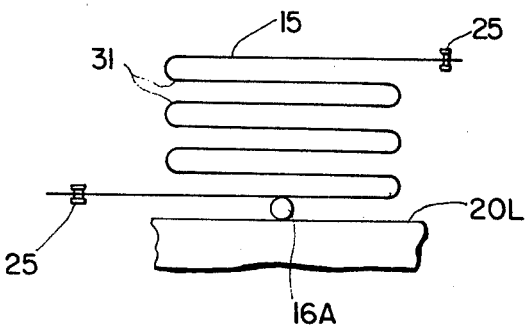

As shown in phantom line the ridge poles (17) pivot about axis 30 for erection and storage in the down position (17A) alongside coaming 20. The unassembled tent fabric is folded as in FIG. 2 in several layers or folds 31 (such as about seven) along a longitudinal coaming 20L and are rolled from the end coaming 20E positions inwardly about bobbins 32, such as 3 inches (7.62 cm) diameter hollow aluminum piping, FIG. 3, for storage amidships on the coaming 20. As shown diagrammatically by folds 33, etc. (the pipes being shown without obscuring by the wound fabric layers) the edges of the fabric have the connectors 25 therein for securing by chain 27 and hooks 26 at the first edge as the bobbins 32 are rolled apart along the coaming 20L as designated by arrows 33, 34 over the folded over ridge cable 16A, preferably positioned on the top of coaming 20L, as held between pivoted down ridge poles (17A). This assembly-erection process can be done with two men rolling the bobbins, etc. and coupling hooks on one side as the unrolling takes place.

Then after the bobbins 32 are removed and the folds 31 (FIG. 2) extend along the length of coaming 20L with the cover therealong fastened down by the hook-chain assemblies, the cover layers 31, etc. are pulled across the coaming loosely and two winches 40, 41 are manned to pull the ridge poles 17, 18 erect by means of guy stays 42, 43 attached to the winches, thereby causing ridge cable 16A to help spread and to lift the fabric into place in its gable posture until limited by fixed length stays 44, 45 and taut stay tension in 42, 43. The phantom arrows 46 signify this range of pivot movement about axis 30.

Winch 50 then can tighten the ridge cable 16 held loosely during erection, and aiding when taut the end stay guy cables 51 to support the hatch cover during a transport trip. This winch 50 is operated after the connector arrays along the entire coaming longitudinal walls 20L are fastened, thereby tautening the fabric in place in its pup-tent array. The end flaps then are secured at coaming ends 20E. This procedure can be reversed to remove the cover.

A typical barge hatch is about 30 feet (9.14 m) wide by 175 feet (53.3 m) in length and this with the thin plastic film fabric above described is easily erected with two men and not more than six man hours as assisted by built in 5 ton winches 40, 41 and 10 ton winch 50. It will be appreciated that there is no danger of the sparks encountered with steel rubbing on steel in conventional cover mount procedures. Also, the weight of the assembly is so light that extra tons of pay-load cargo may be carried.

Figure 4A:
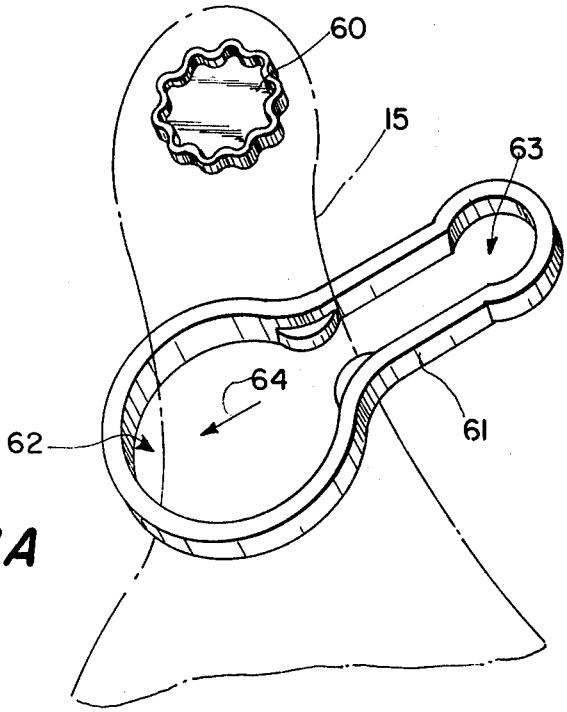
FIG. 4A is a perspective sketch of an alternative connector assembly.
Figure 4:
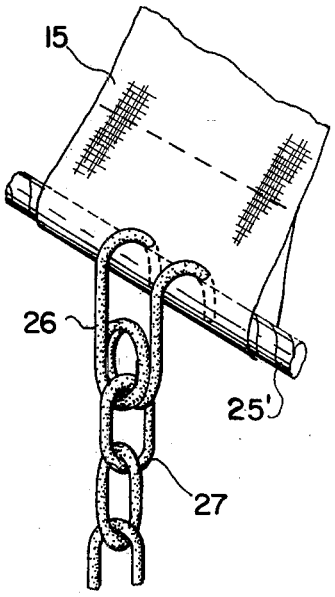
FIG. 4 is a perspective sketch in partially assembled position, with the tent fabric in phantom line, of a preferred rope assembly for securing the edges of the tent fabric with claw hooks to the barge.

A preferred claw hook structure is shown in FIG. 4 wherein the aforementioned plastic film fabric 15 is shown with the claw hook 26′ inserted through the film and held by a polypropylene rope 25′ which is inserted along the edge of the cover and sealed in place. The connection of the hook to the cover is made by the insertion of the hook points through the plastic and hooks are held in place along the coaming on approximately 4 foot centers by short lengths of chain secured to the barge coaming.

The polypropylene rope 25′ is secured at the forward and after end of the coamings as well as across the ends of the coaming. This arrangement provides a taut edge for the cover as well as some flexibility in the placement of claw hooks. When cover is not in service claw hooks 26′ and chain 27 hang from the coaming clear of the deck and the access areas.

An alternative grommet structure is shown in FIG. 4A wherein the aforementioned plastic film fabric 15 is shown in phantom view midway in the process of inserting a grommet assembly comprising a disc 60 and an oblong ring 61 with a larger ring dimension 62 at one end and a reduced size neck 63 at the other end. Thus, a fold is made in the fabric 15 over the disc 60 and the larger ring 62 is slipped over fabric with internal disc 60, the fabric folds being therebetween to end up in substantially the shown condition. Then the oblong ring 61 is moved left as in arrow 64 to move the reduced size neck 63 over the folded fabric thereby retaining disc 60 in a fabric pocket.

If the fabric 15 is pulled downwardly disc 60 is stopped against the reduced dimension neck 63 of oblong ring 61 and the larger ring 62 extends as a grommet ring for receiving the claw hook aforementioned. The friction between the disc 60, the fabric 15 with folds therein, and the neck 63 of oblong ring 61 holds the grommet tightly in place without slipping.

Figure 5:
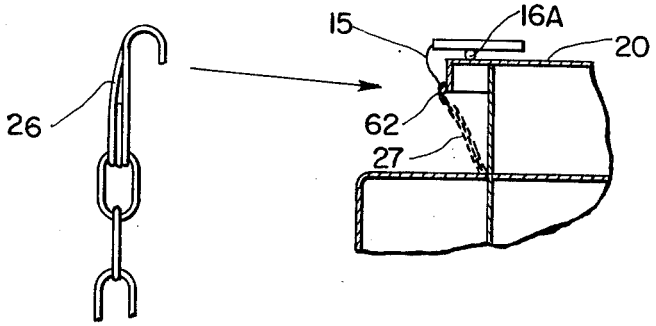
FIG. 5 is a broken away segmental view, partly in section, with an enlarged blowup detail, of the fastener assembly about the edges of the tent fabric.
Figure 6:
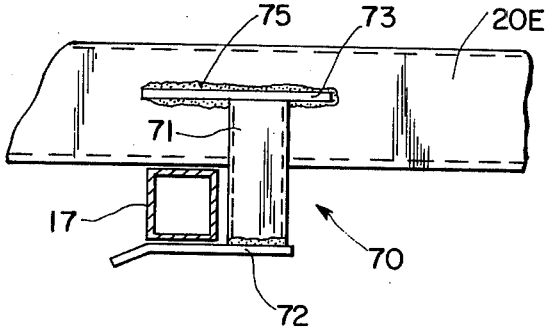
FIGS. 6 through 10 are broken away segmental views of the ridge pole assembly and mount respectively showing top view section, lower portion side view elevation, top view cap assembly detail, upper side view stay and ridge cable coupling and upper end view stay coupling.
Figure 7:
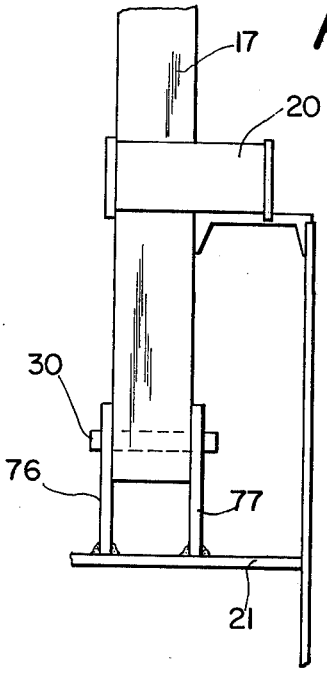
Figure 8:
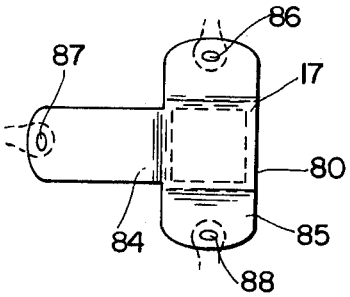
Figure 9:
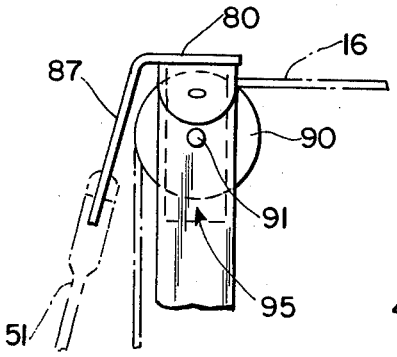
Figure 10:
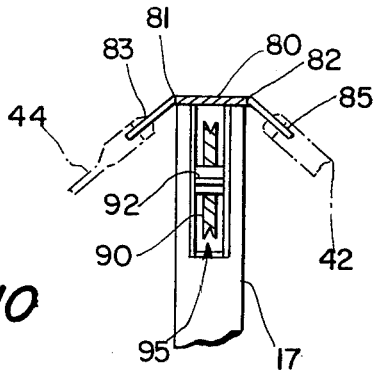

FIG. 5 shows the chain 27 and claw hook 26 which engage the rope, in the preferred case, and typifies the folded layers of fabric 15 as laying on cable 16A on coaming 20 just before the ridge poles 17, 18 are erected with the outer rope edge fastened down.

The structure of the ridge poles is detailed in FIGS. 6 through 10. Thus, ridge pole 17 is a 6 inch (15.24 cm) by 6 inch (15.24 cm) steel tubing held up by ½ inch (1.27 cm) plastic coated wire rope cables. In upright position it is held by winch 40 against stop array 70 on coaming 20E comprising a 3 inch (7.62 cm) square steel tubing 71 welded to ½ inch (1.27 cm) flanges 72, 73 and affixed to coaming 20E by welds 74.

The ridge pole 17 is pivoted about 2 inches (5.08 cm) diameter pin 30 which is 8 ½ inches (21.59 cm) long and held in place conventionally by pins, nuts or the like not shown and mounted between ¾ inch (1.9 cm) thick steel flanges 76, 77 welded to deck 21 at a 4 ¼ inch (10.8 cm) spacing.

Mounted by welding on top of the ridge pole 17 is cap 80 with rounded corners 81, 82 to prevent tearing or undue friction with the fabric when raised and having tabs 83, 84, 85 about 19 inches (48.26 cm) long for the back stay and 8 inches (20.32 cm) long for the side stays and sloping downwardly with guywire stay receiving apertures 86, 87, 88. Beneath the cap 80 is a ridge cable pulley 90 mounted for rotation on shaft 91 in a bearing 92 located in a slot 95 at the upper extremity of ridge pole 17. The ridge pole is typically 15 feet (4.57 m) high.

Figure 11:
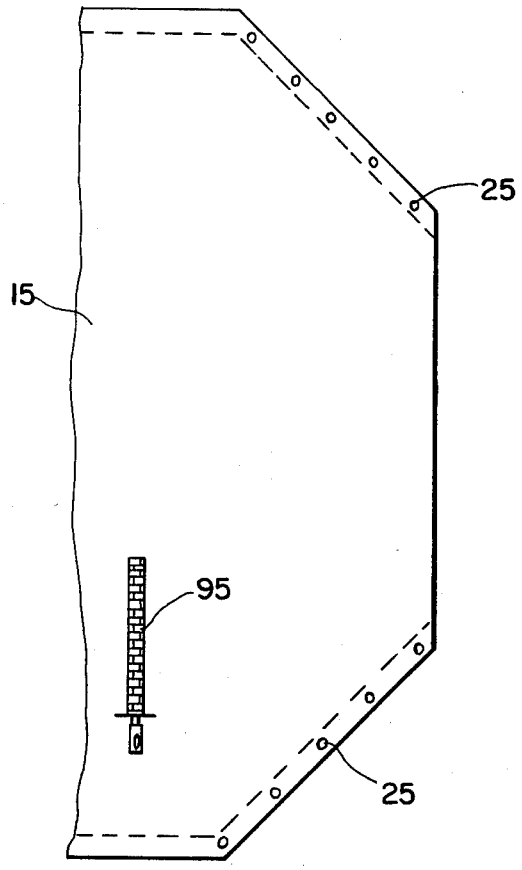
FIG. 11 is a plan view of the end construction of the tent fabric and illustrates a loading access entryway.
Figure 12:
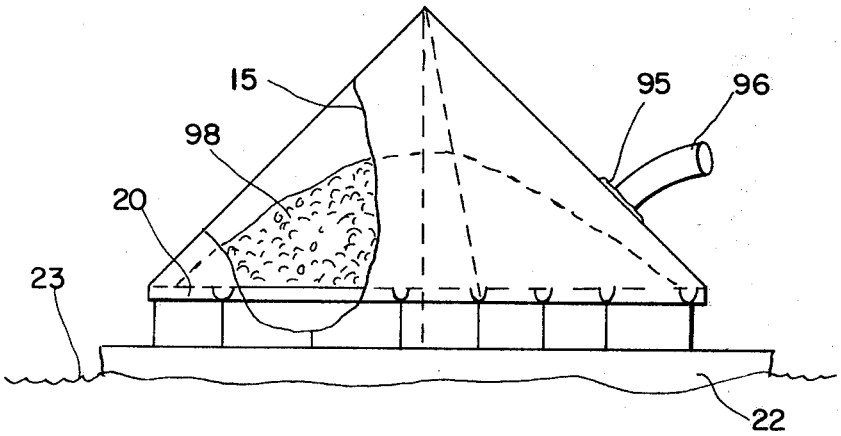
FIG. 12 is an end view, assembled of the tent cover in place over a typical perishable cargo such as wheat.

As seen in FIG. 11, the ends of the fabric sheet 15 are formed so they can extend around the ridge poles and guys and fold thereabout for fastening as aforesaid by claw hook 25. Spaced on the side (one gable as erected) of the fabric is a selectively operable water-proof opening represented by zipper 95, so that a snout 96 of a conveyor pipe for grain or the like can be inserted inside the hatch cover for loading in foul weather as shown in FIG. 12. Wheat, for example, would be spoiled by loading in wet weather in an open hatch of a barge 22 docked in an uncovered water 23 berth.

Also, as seen from the break-away fabric end view, the cargo 98 such as wheat can be extended above the coaming 20 level as shown for greater pay-loads because of the pup-tent like cover extending above the coaming between ridge poles.

Having therefore advanced the state of the art with the aforegoing novel features of apparatus and method, the requirements for letters patent are met for the invention whose novel features descriptive of the spirit and nature thereof are set forth with particularity in the appended claims.

What is claimed is:

1. In a barge having an open hatch with a coaming therearound, the improvement comprising a hatch cover assembly provided with two spaced ridge poles positioned to support above the hatch coaming a lightweight weatherproof fabric covering over the hatch in a pup-tent like array wherein the ridge poles are movably supported for stowing in a lowered position, when not in use to support the fabric, the movable support for the ridge poles comprises a pivot assembly positioned on the barge deck amidships at respective fore and aft ends of the hatch coaming and including two support stays attached to the coaming at port and starboard sides, and one of the stays is attached to a tightening winch that permits the pole to be moved by the winch from a lowered pivot position alongside the respective fore and aft coamings to an upright midships position with taut stays.

2. The improvement defined in claim 1 wherein a ridge cable having draped thereover and supporting said fabric between said ridge poles is attached at one end to a cable tightening winch affixed to said barge.

3. The improvement defined in claim 1 having a cable connected between the said ridge poles supporting a pup-tent like hatch-cover array wherein the fabric comprises a thin reinforced plastic film and means fastening the film edges extending over the entire periphery of the coaming in a water tight array to prevent entry of water into the hatch as the barge is under way.

4. The improvement defined in claim 3 including a set of tie-down strap members attached to the barge deck at spaced intervals outside the hatch coaming with hook members mating with connectors in the plastic film to secure the film edges in a taut condition.

5. The improvement defied in claim 3 wherein the film edges are affixed to the barge by means of grommet structure consisting of a disc held in the plastic film by the reduced size neck ring of an oblong ring member having a larger ring dimension at one end that will slip over said disc and the reduced neck ring at the other end of smaller size than said disc thereby engaging plastic folds encompassing the disc to hold the disc immovably within a pocket formed by said film leaving the larger ring end extending unobstructed for attachment to a hook member.

6. The improvement defined in claim 3 wherein the plastic film has at least one selectively openable accessway therethrough for inserting loading and unloading means when the tent like array is erected and in place over the hatch.

7. The improvement defined in claim 3 wherein the cover edges are affixed to the barge by means of a connector in the cover comprising a polypropylene rope structure enclosed by the cover material along its edge along its entire length and mating connectors affixed to the barge comprising claw hooks attached to chains located along the coaming, allowing unrestricted attachment of the cover edge to the barge at any point along the edge of the cover.

* * * * *